US009169851B2

(12) United States Patent
Oh et al.

(10) Patent No.: US 9,169,851 B2
(45) Date of Patent: Oct. 27, 2015

(54) AIR CONDITIONER

(71) Applicants: Siyoung Oh, Changwon-si (KR); Song Choi, Changwon-si (KR); Yongcheol Sa, Changwon-si (KR); Seokho Choi, Changwon-si (KR)

(72) Inventors: Siyoung Oh, Changwon-si (KR); Song Choi, Changwon-si (KR); Yongcheol Sa, Changwon-si (KR); Seokho Choi, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 280 days.

(21) Appl. No.: 13/753,781

(22) Filed: Jan. 30, 2013

(65) Prior Publication Data

US 2013/0239605 A1 Sep. 19, 2013

(30) Foreign Application Priority Data

Jan. 31, 2012 (KR) ..... 10-2012-0009653

(51) Int. Cl.

| | |
|---|---|
| ***F25D 19/00*** | (2006.01) |
| ***F25D 25/00*** | (2006.01) |
| ***F04B 35/04*** | (2006.01) |
| ***F04D 29/64*** | (2006.01) |
| ***F24F 1/38*** | (2011.01) |
| ***F24F 1/00*** | (2011.01) |
| ***F24F 1/40*** | (2011.01) |
| ***F04D 25/08*** | (2006.01) |
| ***F04D 29/52*** | (2006.01) |

(52) U.S. Cl.

CPC ..... *F04D 29/646* (2013.01); *F04D 25/08* (2013.01); *F04D 29/522* (2013.01); *F24F 1/0029* (2013.01); *F24F 1/38* (2013.01); *F24F 1/40* (2013.01)

(58) Field of Classification Search

CPC ..... F24F 1/38; F24F 1/0029; F24F 1/40; F24F 13/084; F24F 13/32; F25B 2500/12; F04D 29/646; F04D 25/08; F04D 25/12; F04D 29/522; F04D 29/66; F04D 29/663; F04D 29/667

USPC ..... 62/428, 295–298, 259.1, 450, 465; 417/423.15

See application file for complete search history.

(56) References Cited

U.S. PATENT DOCUMENTS

| | | | | |
|---|---|---|---|---|
| 4,501,194 | A * | 2/1985 | Brown | 454/354 |
| 6,074,182 | A * | 6/2000 | Matson | 417/423.15 |
| 6,190,140 | B1 * | 2/2001 | Matson | 417/362 |
| 2009/0114376 | A1 * | 5/2009 | Ishida et al. | 165/104.31 |

* cited by examiner

*Primary Examiner* — Frantz Jules
*Assistant Examiner* — Joseph Trpisovsky
(74) *Attorney, Agent, or Firm* — Ked & Associates LLP

(57) ABSTRACT

An air conditioner is provided. The air conditioner includes a blowing fan in which a plurality of blades are provided; a fan motor rotating the blowing fan; and a motor mount supporting the fan motor, wherein cut parts are formed in the motor mount by cutting at least a part of a surface passing above the motor mount while the blades are rotated.

20 Claims, 7 Drawing Sheets

AIR CONDITIONER

BACKGROUND

1. Field of the Disclosure

The present invention relates to an air conditioner, and more particularly, to an air conditioner installed in an exterior of a room.

2. Description of the Related Art

In general, an air conditioner is a device of processing suction air and supplying the processed suction air to a building or a room so that indoor air maintains a comfortable condition, and is classified into a window type and a separate or split type.

The separate or slit type air conditioner includes an indoor unit cooling or heating indoor air through heat exchange between a refrigerant and the indoor air, and an outdoor unit cooling or heating outdoor air through heat exchange between the refrigerant and the outdoor air.

The outdoor unit includes a blowing fan flowing outdoor air for exchanging heat with a refrigerant circulating via an outdoor heat exchanger and a fan motor driving the blowing fan.

The fan motor is fixed and mounted to a motor mount which is fixed to the inside of the outdoor unit.

SUMMARY

The present invention has been made in an effort to solve the above problems, and the present invention provides an air conditioner which reduces noise of a blowing fan.

According to an aspect of the present invention, there is provided air conditioner, including: a blowing fan in which a plurality of blades are provided; a fan motor rotating the blowing fan; and a motor mount supporting the fan motor, wherein at least one cut part is formed in the motor mount in the surface of the motor mount facing the plane of rotation of the blowing fan.

The location of the at least one cut our part is preferably such that, when viewed along the rotational axis of the blowing fan, the areal surface of rotation of the blowing fan overlaps with at least a part of the at least one cut part.

The motor mount may include a top surface in which the at least one cut parts are provided, a bottom surface spaced from the top surface, and a side surface connecting one side of the bottom surface to one side of the top surface.

According to a preferred embodiment, a coupling part coupling the fan motor is provided in the motor mount.

The cut parts may be provided at opposite sides of the coupling part.

The cut parts may include a first cut part and a second cut part.

The second cut part is preferably longer than the first cut part.

The motor mount may include a first motor mount and a second motor mount supporting the fan motor on two sides thereof, respectively.

The first motor mount and the second motor mount may be provided parallel to each other.

The first cut part formed in the first motor mount and the first cut part formed in the second motor mount are provided diagonally with respect to the axis of the fan motor, and the second cut part formed in the first motor mount and the second cut part formed in the second motor mount are provided diagonally with respect to the axis of the fan motor.

The motor mount may further include an air passage along its longitudinal axis.

The cut parts may extend from the air passage.

The at least one cut part may be formed in the motor mount such that it is open at one side thereof.

The air passage formed at the first motor mount may be disposed opposite to one side of the fan motor, and the air passage formed at the second motor mount may faces the opposite side of the fan motor.

The air conditioner may further comprise a chassis frame supporting both ends of the motor mount.

Coupling parts may be formed at both ends of the motor mount so that the motor mount is coupled and supported to the chassis frame.

The air conditioner may further comprise at least one strength reinforcing part in the form of a protrusion or indentation is provided in at least one surface of the motor mount.

A length of the at least one strength reinforcing part may be equal to or greater than a length of the cut parts.

The at least one strength reinforcing part is provided in the side surface, in the bottom surface, or in both the side surface and the bottom surface of the motor mount.

The at least one strength reinforcing part may extend from the first cut part to the second cut part.

Meanwhile, the embodiments are not limited to the above object, and those skilled in the art can clearly understand other objects from following description.

BRIEF DESCRIPTION OF THE DRAWING

The present invention will become more fully understood from the detailed description given herein below and the accompanying drawings, which are given by illustration only, and thus are not limitative of the present invention, and wherein.

DETAILED DESCRIPTION OF THE EMBODIMENT

Hereinafter, exemplary embodiments according to the present invention will be described in detail with reference to the accompanying drawings. The present inventive concept may, however, be embodied in many different forms and should not be construed as limited to the example embodiments set forth herein. Rather, these example embodiments are provided so that this description will be thorough and complete, and will fully convey the scope of the present inventive concept to those skilled in the art. The same reference numbers are used throughout the drawings to refer to the same or like parts. Detailed descriptions of well-known functions and structures incorporated herein may be omitted to avoid obscuring the subject matter of the present invention.

Hereinafter, an air conditioner according to exemplary embodiments according to the present invention will be described in detail with reference to the accompanying drawings.

Figure 1:
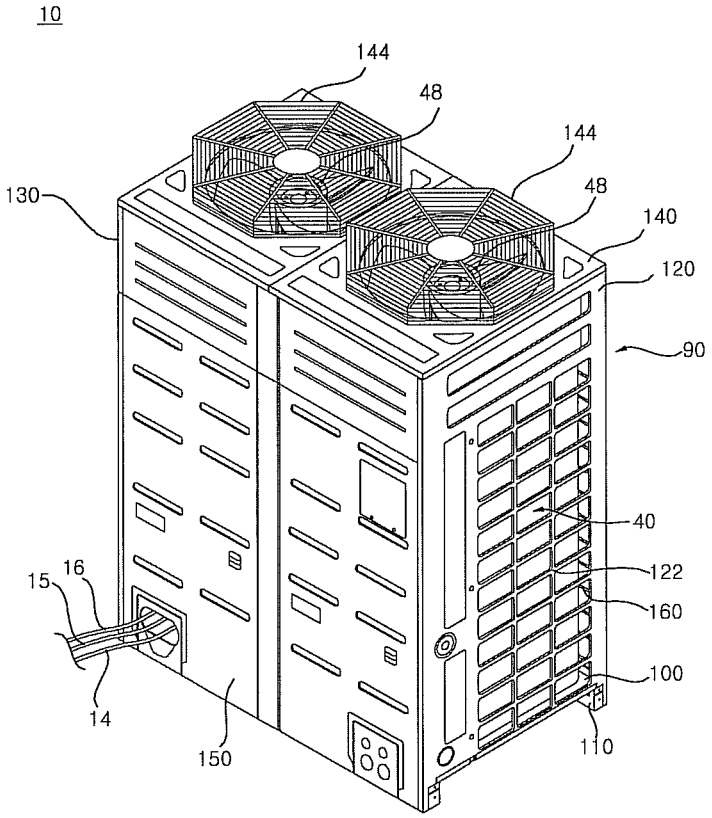
FIG. 1 is a perspective view illustrating an air conditioner according to an exemplary embodiment of the present invention.
Figure 2:
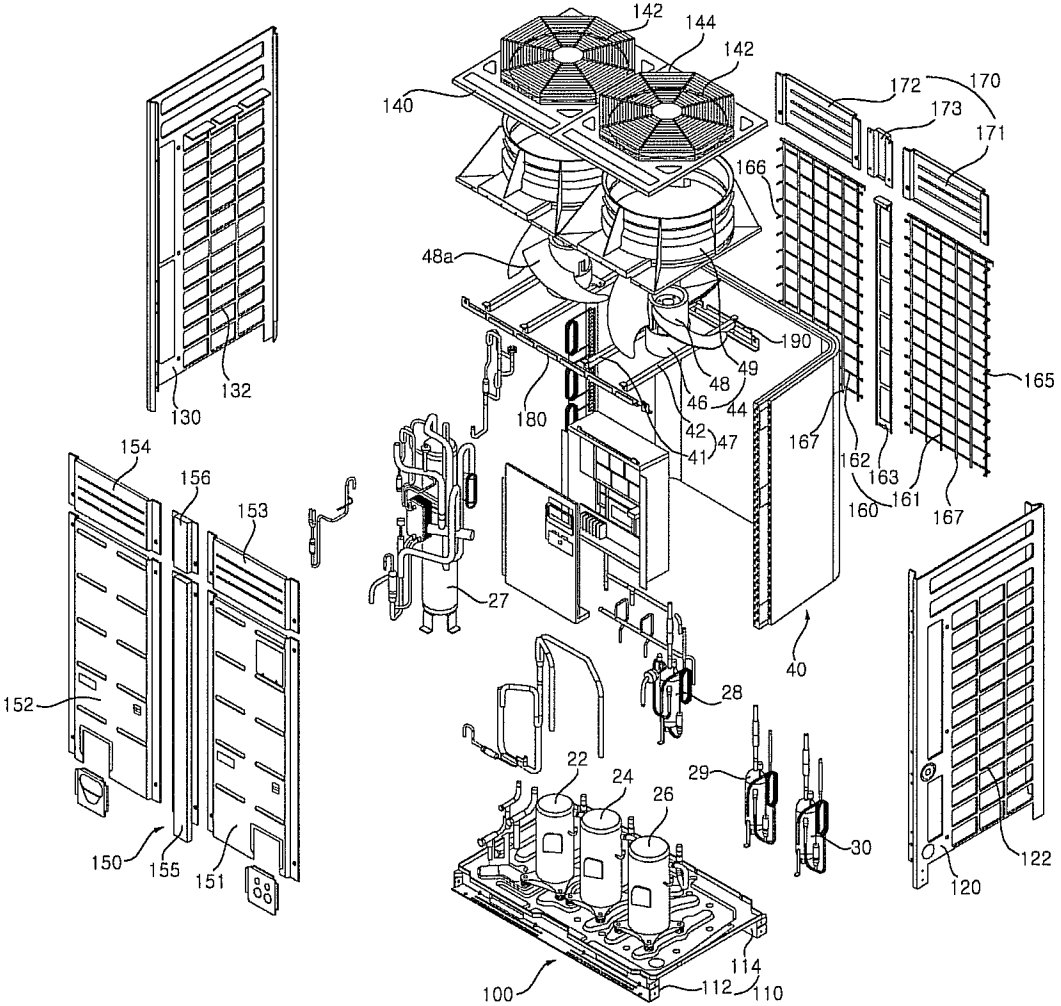
FIG. 2 is an exploded perspective view of FIG. 1.

FIG. 1 is a perspective view illustrating an air conditioner according to an exemplary embodiment of the present invention, and FIG. 2 is an exploded perspective view of FIG. 1.

Referring to FIGS. 1 and 2, the air conditioner according to an embodiment of the present invention is an outdoor unit 10 installed in an exterior of a room, and may be connected to an indoor unit (not shown) installed in an interior of the room through refrigerant pipes 14, 15, and 16.

Compressors 22, 24, and 26, an accumulator 27, oil separators 28, 29, and 30, a heat exchanger 40, and a blower 44 are provided inside a case 90 of the outdoor unit 10.

The case 90 forms an outer appearance of the outdoor unit 10, and includes a base fan 100, a left panel 120, a right panel 130, a top panel 140, a front panel 150, a suction grill 160, and a rear panel 170.

The base fan 100 forms an outer appearance of a bottom surface of the outdoor unit 10, and the compressors 22, 24, and 26, the oil separators 28, 29, and 30, the accumulator 27, and the heat exchanger 40 are provided in an upper side of the base fan 100.

A plurality of legs 110 are spaced apart from each other in a lower side of the base fan 100, and may support the base fan 100 to be spaced apart from the ground.

The legs 110 may integrally protrude from the base fan 100. The legs 110 may be manufactured separately from the base fan 100 and then be coupled by the base fan 100 and a coupling member such as a screw.

The legs 110 include a front leg 112 longitudinally provided in a lower side of a front portion of the base fan 100 left and right, and a rear leg 114 longitudinally provided in a lower side of a rear portion of the base fan 100 left and right.

The left panel 120 forms an outer appearance of a left side of the outdoor unit 10. The left panel 120 is coupled to a left side of the base fan 100 and a left grill 122 is provided such that outdoor air may be sucked in the outdoor unit 10.

The right panel 130 forms an outer appearance of a right side of the outdoor unit 10. The right panel 130 is coupled to a right side of the base fan 100 and a right grill 132 is provided such that outdoor air may be sucked in the outdoor unit 10.

A top panel 140 forms an outer appearance of a top surface of the outdoor unit 10. The top panel 140 is coupled to upper sides of the left panel 120 and the right panel 130, and a discharge hole 142 is formed in the top panel 140 and air blown from the blower 44 flows through the discharge hole 142.

A discharge grill 144 disposed in an upper side of the discharge hole 142 is provided in the top panel 140.

The front panel 150 forms an outer appearance of a front surface of the outdoor unit 10. The front panel 150 is provided in front directions of the base fan 100, the left panel 120, a right panel 130, and the top panel 140, and a plurality of holes are formed in the front panel 150 such that outdoor air may be sucked in the outdoor unit 10.

The front panel 150 includes lower front panels 151 and 152 provided at a height corresponding to the heat exchanger 40, and upper front panels 153 and 154 provided at upper sides of the lower front panels 151 and 152.

When a horizontal width of the front panel 150 is short, one lower front panel 151 and 152 and one upper front panels 153 and 154 are provided, respectively. Conversely, when the horizontal width of the front panel 150 is long, a plurality of lower front panels 151 and 152 and upper front panels 153 and 154 are provided, respectively.

When a plurality of lower front panels 151 and 152 and upper front panels 153 and 154 are provided, the front panel 150 further includes a front lower middle support 155 provided between the lower front panels 151 and 152 and coupled to the lower front panels 151 and 512, and a front upper middle support 156 provided between the upper front panels 153 and 154 and coupled to the upper front panels 153 and 154.

The suction grill 160 forms an outer appearance of a lower portion of a rear surface of the outdoor unit 10. The suction grill 160 is provided in an upper side of the base fan 100 in a height corresponding to a height of the heat exchanger 40 such that outdoor air may be sucked in the outdoor unit 10.

When a horizontal width of the suction grill 160 is short, one suction grill 160 is provided. When the horizontal width of the suction grill 160 is long, a plurality of suction grills is provided. When a plurality of suction grills 161 and 162 are provided, the suction grill 160 further includes a grill supporter 163 provided between the suction grills 161 and 162 and coupled to the suction grills 162.

Side end coupling parts 165 and 166 coupled to the left panel 120 or the right panel 130 through a coupling member such as a screw are provided in one of left sides and right sides of the suction grills 161 and 162, and a lower end mounting part 167 mounted on an edge of the base fan 100 is provided in a lower side thereof.

The rear panel 170 forms an outer appearance of an upper portion of a rear surface of the outdoor unit 10, and is coupled to the top panel 140.

When a horizontal width of the rear panel 170 is short, one rear panel 170 is provided. When the horizontal width of the rear panel 170 is long, a plurality of rear panels 171 and 172 are provided. When the rear panels 171 and 172 are provided, the rear panel 170 further includes a rear supporter 173 provided between the rear panels 171 and 172 and coupled to the rear panels 171 and 172.

Chassis frames 180 and 190 to which the left panel 120, the right panel 130, the front panel 150, the suction grill 160, and the rear panel 170 are coupled are provided inside the case 90.

The chassis frames 180 and 190 include a front chassis frame 180 longitudinally coupled to a front portion of the left panel 120 and a front portion of the right panel 130 left and right, and a rear chassis frame 190 longitudinally coupled to a rear portion of the left panel 120 and a rear portion of the right panel 130 left and right.

Upper portions of the lower front panels 151 and 152 and the lower middle supporter 155, and lower portions of the upper front panels 153 and 154 and the upper middle supporter 156 are coupled to the front chassis frame 180.

Upper portions of the suction grills 161 and 162 and the grill supporter 163 are coupled to a rear chassis frame 190, and lower portions of the rear panels 171 and 172 and the rear support 173 are coupled to the rear chassis frame 190.

The compressors 22, 24, and 26, the accumulator 27, and the oil separators 28, 29, and 30 are connected to the heat exchanger 40 through the refrigerant pipes 14, 15, and 16 such that the heat exchanger 40 may exchange heat with outdoor air by a refrigerant flowing through the heat exchanger 40.

The compressors 22, 24, and 26 compress the refrigerant, and a plurality of refrigerant passages are connected to each other in parallel in the compressors 22, 24, and 26.

Suction sides of the compressors 22, 24, and 26 are connected to one common accumulator 27, and discharge sides of the compressors 22, 24, and 26 are connected to the oil separators 28, 29, and 30, respectively.

The accumulator 27 stores the refrigerant and supplies the stored refrigerant to the compressors 22, 24, and 26 as needed. The oil separators 28, 29, and 30 separate oil included in the refrigerant for lubrication operation of the compressors 22, 24, and 26.

A front surface of the heat exchanger 40 has a U shape, which is open and the open front surface of the heat exchanger 40 faces the front panel 150. The heat exchanger 40 include a left portion located in a right side of the left panel 120, a rear portion located in a front direction of the suction grill 160, and a right side located in a left side of the right panel 130.

During a cooling operation, the heat exchanger 40 acts as a condenser. During a heating operation and defrosting operation, the heat exchanger 40 acts as an evaporator, and a refrigerant passage through which the refrigerant flows is formed in the heat exchanger 40 such that the refrigerant is heat-exchanged with air introduced in the case 90.

A blower 44 is provided in an upper side of the heat exchanger 40 and blows through outdoor air heat-exchanged with the heat exchanger 40.

The blower 44 is provided between an upper portion of the left panel 120 and an upper portion of the upper front panel 130 and between the upper front panels 153 and 154 and the rear panel 170, and is put and installed on the front chassis frame 180 and the rear chassis frame 190.

The blower 44 includes a blowing fan 48 blowing outdoor air heat-exchanged with the heat exchanger 40 into the discharge hole 142 formed in the top panel 140, a fan motor 46 rotating the blowing fan 48, and a shroud 49 forming a flow passage of the blowing fan 48 to surround the blowing fan 48.

The center of the blowing fan 48 is coupled to the fan motor 46, and a plurality of blades 48*a* are provided in the blowing fan 48 such that the outdoor air heat-exchanged with the heat exchanger 40 is sucked and blown into the discharge hole 142.

The fan motor 46 is supported by the motor mount 47 coupled to chassis frames 180 and 190.

Both ends of the motor mount 47 are coupled and supported to the front chassis frame 180 and the rear chassis frame 190.

The motor mount 47 includes a first motor mount 41 and a second motor mount 42 supporting both sides of the fan motor 46 while interposing the fan motor 46 therebetween. The first motor mount 41 and the second motor mount 42 are linearly formed to have the same shape and are provided parallel to each other.

Hereinafter, a motor mount 47 will be described with reference to FIGS. 3 to 7.

Figure 3:
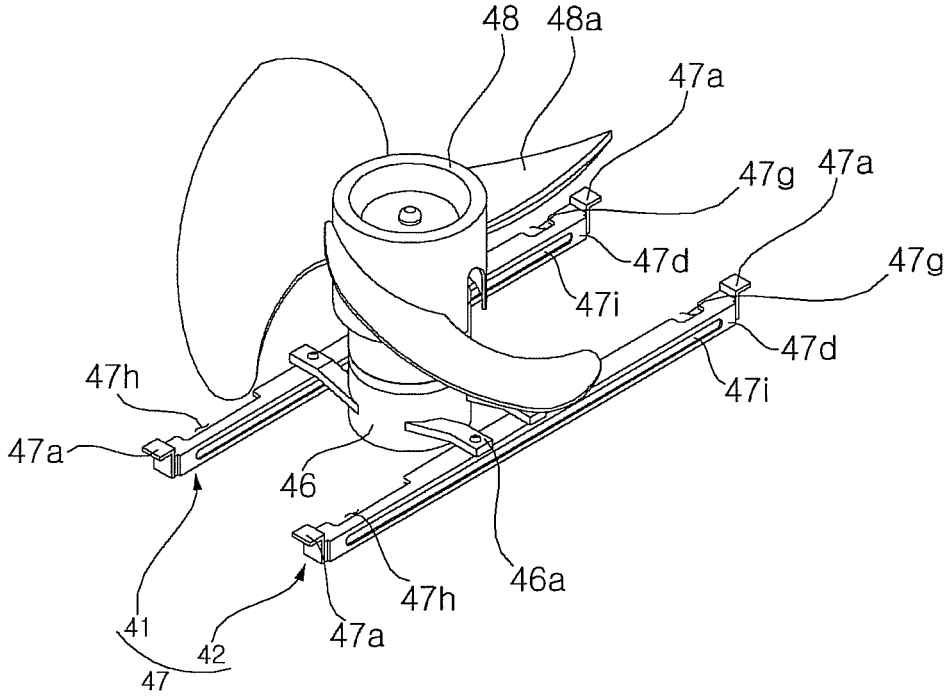
FIG. 3 is a view illustrating a blowing fan, a fan motor, and a motor mount shown in FIG. 2.
Figure 4:
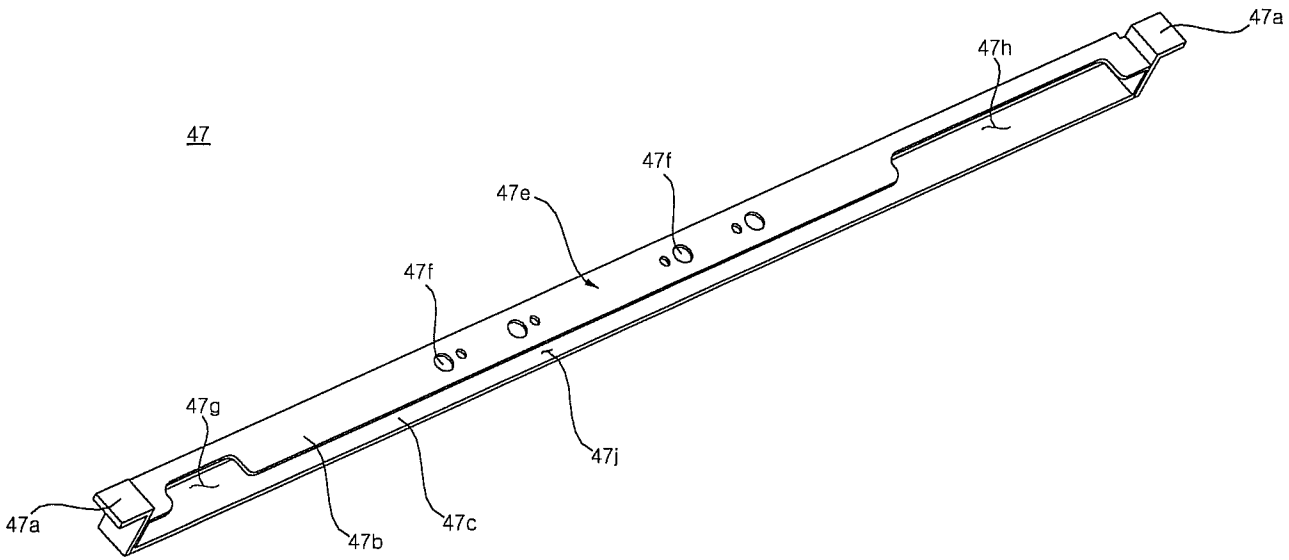
FIGS. 4 and 5 are views illustrating a motor mount shown in FIG. 3.
Figure 5:
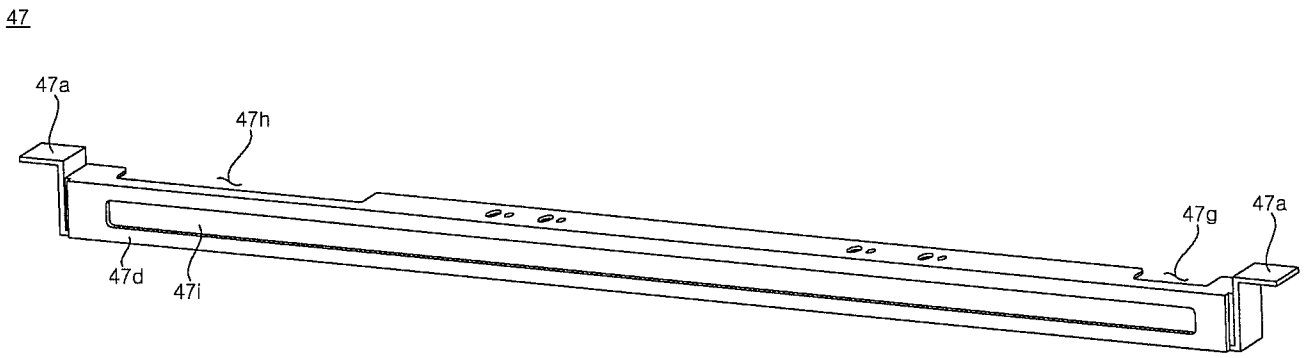

FIG. 3 is a view illustrating a blowing fan, a fan motor, and a motor mount shown in FIG. 2, and FIGS. 4 and 5 are views illustrating a motor mount shown in FIG. 3.

Referring to FIGS. 3 to 5, curved parts 47*a* are curved at both ends of the motor mount 47 so that the curved parts 47*a* are coupled and supported to the chassis frames 180 and 190, respectively. The curved parts 47*a* have a 'ㄱ' shape to be mounted on upper sides of the chassis frames 180 and 190, a front end of the motor mount 47 may be mounted on the front chassis frame 180 and be coupled through a coupling member and a rear end of the motor mount 47 may be mounted on the rear chassis frame 190 and be coupled through the coupling member.

One surface of a portion of the motor mount 47 except for the curved part 47*a* is longitudinally open to have a 'ㄷ' shaped section. The motor mount 47 includes a top surface 47*b*, a bottom surface 47*c* spaced from the top surface 47*b* to a lower side, and a side surface 47*d* connecting one side of the bottom surface 47*c* to one side of the top surface 47*b*.

When a plurality of blades 48*a* are rotated, one open surface of the motor mount 47 becomes an air passage 47*j* through which air moving by the blades 48*a* flows.

A side 47*d* of the first motor mount 41 faces one side of the fan motor 46 so that the air passage 47*j* formed at the first motor mount 41 is disposed opposite to one side of the fan motor 46. A side 47*d* of the second motor mount 42 is disposed opposite to an opposite side of the fan motor 46 so that the air passage 47*j* formed at the second motor mount 42 faces the opposite side of the fan motor 46.

It is preferable that the fan motor 46 is supported to the center of the motor mount 47 so that drooping of the motor mount 47 may be prevented. Accordingly, a coupling part 47*e* coupling the fan motor 46 to the center of the top surface 47*b* so that the fan motor 36 may be supported to the center of the top surface 47*b*.

Ribs 46*a* may be provided in both sides of the fan motor 46 to be mounted and coupled to the coupling part 46*e*.

A plurality of coupling holes 47*f* are formed in the coupling part 47*e* so that the coupling part 47*e* may be coupled with the ribs 46*a* of the fan motor 46 through a coupling member. The coupling hole 47*f* is not formed in the coupling part 47*e* but a coupling protrusion may be formed in the coupling part 47*e*, in which is inserted into and coupled to the rib 46*a* of the fan motor 46.

When the blowing fan 48 is rotated, the motor mount 47 is provided in a location which the blades 48*a* passes through the motor mount 47 while overlapping with the motor mount 47. Accordingly, when the blowing fan 48 rotates, air at a lower side of the motor mount 47 flow to a plurality of blades 48*a* upward, and collides with the motor mount 47 so that a fan noise may occur.

To reduce the fan noise, the top surface 47*b* of the motor mount 47 is cut such the cut parts 47*g* and 47*h* are formed. The cut parts 47*g* and 47*h* may be formed by cutting at least a part of the top surface 47*b*, which is a surface passing through the motor mount 47 while the blades 48*a* are rotated.

The cut parts 47*g* and 47*h* extend from the air passage 47*j*. Accordingly, air flowing through the air passage 47*j* is discharged through the cut parts 47*g* and 47*h* by rotating the blades 48*a*.

The cut parts 47*g* and 47*h* are formed in both sides of the coupling part 47*e*. The cut parts 47*g* and 47*h* have different lengths. That is, the cut parts 47*g* and 47*h* include a first cut part 47*g* formed in one side of the coupling part 47*e* and having a shorter length, and a second cut part 47*h* formed at an opposite side of the coupling part 47*e* and having a longer length.

The first cut part 47*g* formed in the first motor mount 41 and the second cut part 47*h* formed in the second motor mount 42 are provided diagonally with respect to the axis of the fan motor 46. The second cut part 47*h* formed in the first motor mount 41 and the first cut part 47*g* formed in the second motor mount 42 are provided diagonally with respect to the axis of the fan motor 46.

The blowing fan 48 is rotated clockwise above the motor mount 47 in the drawings. Accordingly, because air moving by the blades 48*a* flows in a rotating direction of the blades and collides with the motor mount 47, the second cut part 47*h* being a collided part of the moving air is formed longer so that fan noise may be reduced. Since the sizes of the blades 48*a* are changed according to a specification of an outdoor unit, the second cut part 47*h* is longer than the first cut part 47*g*, so that the motor mount 47 may be used in outdoor units of various specifications in common.

However, when the cut parts 47*g* and 47*h* are formed in the motor mount 47, strength of the motor mount 47 is deteriorated so that drooping by a self way of the blower 44 may occur or distortion may be occur by rotation of the blowing fan 48.

Accordingly, there is a need to secure strength of the motor mount 47. A strength reinforcing part 47*i* is provided in the motor mount 47 and provides strength to the side surface 47*d*. When viewed from an outer side of the side surface 47*d*, the strength reinforcing part 47*i* is depressed in an inner side. When viewed from an inner side of the side surface 47*d*, the strength reinforcing part 47*i* protrudes. The strength reinforcing part 47*i* may protrude to an outer side of the side surface 47*d* and an inner side of the side surface 47*d* may be depressed. The strength reinforcing part 47*i* may be provided in a bottom surface 47*c* of the motor mount 47 or in both of the side surface 47*d* and the bottom surface 47*c*.

One stiff reinforcing part 47*i* is longitudinally formed from a location corresponding to the first cut part 47*g* to a location corresponding to the second cut part 47*h*. One strength reinforcing part 47*i* may be formed in a location corresponding to the first cut part 47*g* or in a location corresponding to the second cut part 47*h*. It is preferable that the strength reinforcing part 47*i* is formed longer than the cut parts 47*g* and 47*h* to secure sufficient strength of the motor mount 47.

Figure 6:
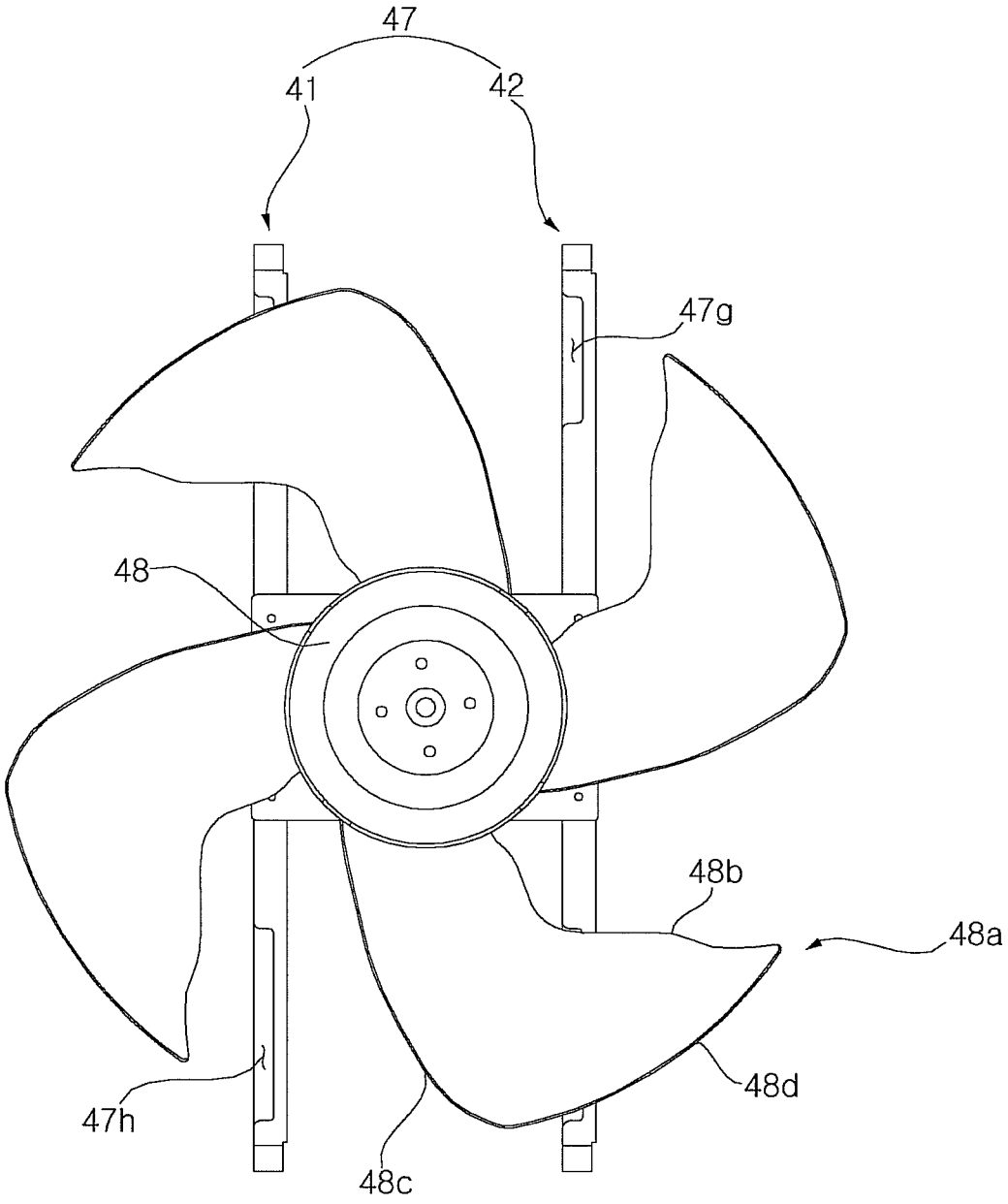
FIG. 6 is a plan view illustrating another example of a blowing fan shown in FIG. 3.
Figure 7:
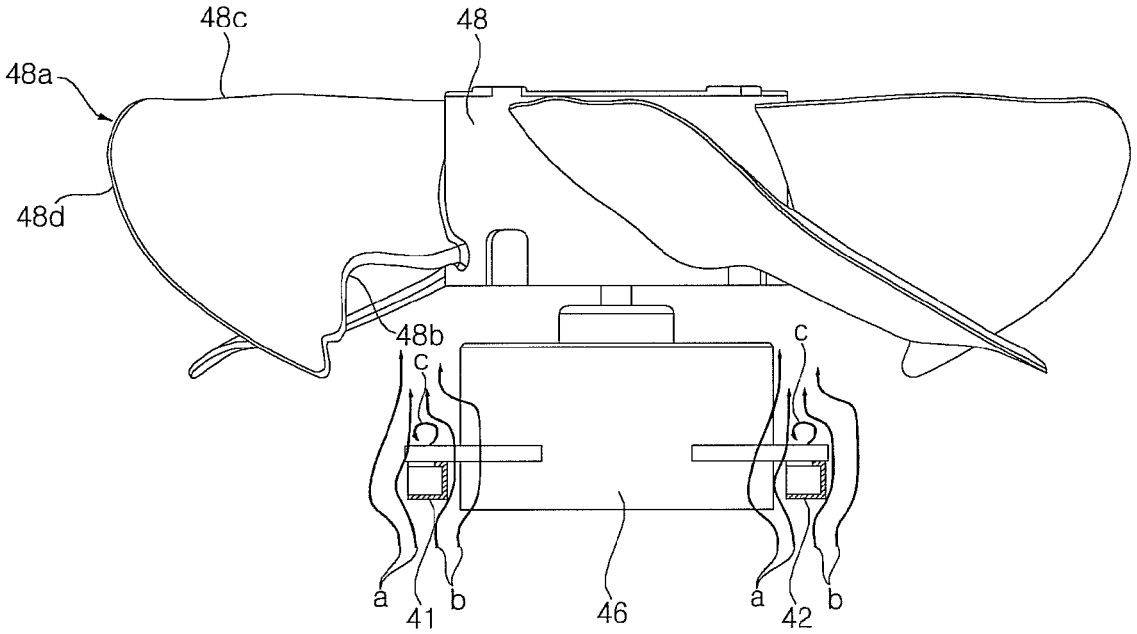
FIG. 7 is a front view of FIG. 6.

FIG. 6 is a plan view illustrating another example of a blowing fan shown in FIG. 3, and FIG. 7 is a front view of FIG. 6.

Referring to FIGS. 6 and 7, it is understood that there is a difference between FIGS. 6 and 7 and FIG. 3.

That is, three blades 48*a* are formed at the blowing fan 48 in FIG. 3, whereas four blades 48*a* are formed at the blowing fan 48 in FIGS. 6 and 7. The number of the blades 48*a* is not limited thereto. That is, two, five or more blades 40*a* may be provided at regular intervals in a rotating direction of the blowing fan 48. FIGS. 6 and 7 have substantially the same configuration as that of FIG. 3. The difference is that four blades 48*a* are provided at the blowing fan 48.

The blade 48*a* includes a first edge 48*b* being a front end of the rotating direction, a second edge 48*c* being a rear end of the rotating direction, and a first edge 48*d* connecting the second edge 48*c* to the first edge 48*b*.

When the blowing fan 48 rotates, the first edge 48*b*, the second edge 48*c*, and the third edge 48*d* are parts which have great pressure difference with peripheral air and cause fan noise. Particularly, when the blowing fan 48, the third edge 48*d* is a part having the highest flow rate of the air, the largest amount of fan noise occurs at a crossing point of the first edge 48*b* and the third edge 48*d*.

Further, when the blowing fan 48 rotates, air at a lower side of the motor mount 47 is moved upward through the plurality of blades 48*a*. the motor mount 47 functions as a resistor blocking flow of air moved upward, and vertex c is formed at an upper side of the motor mount 47. Accordingly, when the blade 48*a* passes through the upper side of the motor mount 47, the air makes contact with the vertex c such that noise may be further increased.

Arrows shown in FIG. 7 indicate flow of air at a lower side of the motor mount 47 moving toward the blade 48*a* upward when the blowing fan 48 rotates. A first flow a indicates flow of air which starts from a lower side of the motor mount 47, passes through one side of the motor mount 47, and is moved to the blade 48*a* through the cut parts 47*g* and 47*h*. A second flow b indicates flow of air which starts from the lower side of the motor mount 47, passes through another side of the motor mount 47, and is moved to the blade 48*a*. The vertex c is formed at an upper side of the motor mount 47 by the first flow a and the second flow b.

If the cut parts 47*g* and 47*h* are not formed at the motor mount 47, a form of the first flow a is similar to a form of the second flow b. In this case, since an interval between the first flow a and the second flow b become wide at an upper side of the motor mount 47, a formation region of the vertex c becomes wide which results in the increase in the noise. However, since the cut parts 47*g* and 47*h* are formed at the motor mount 47 in the embodiment, an interval between the first flow a and the second flow b becomer narrow. Accordingly, the formation region of the vertex c becomes narrow so that the noise can be reduced.

As described above, in the air conditioner according to the present invention, the cut parts 47*g* and 47*h* are provided in the motor mount 47 so that the noise of the blowing fan 48 is reduced.

Further, since the strength reinforcing part 47*i* is provided in the motor mount 47, the drooping and distortion of the motor mount 47 due to the cut parts 47*g* and 47*h* are prevented so that strength of the motor mount 47 is improved.

In the air conditioner according to the present invention, cut parts are provided in the motor mount so that a noise in the blowing fan is reduced.

Further, because the strength reinforcing part is provided in the motor mount, drooping and distortion of the motor mount due to the cut parts are prevented so that strength of the motor mount is improved.

Effects of the present invention are not limited to the foregoing effects, and other effects which are not described may be clearly understood by those skilled in the art from following claims.

The embodiment of the invention being thus described, it will be obvious that the same may be varied in many ways. Such variations are not to be regarded as a departure from the scope of the invention, and all such modifications as would be obvious to one skilled in the art are intended to be included within the scope of the following claims.

The invention claimed is:

1. An air conditioner, comprising:

a blowing fan comprising a plurality of blades;

a fan motor to rotate the blowing fan; and a motor mount to support the fan motor, wherein at least one first cut portion and at least one second cut portion are formed in the motor mount wherein air is discharged through the at least one first cut portion and the at least one second cut portion, wherein the motor mount includes a first surface that faces a plane of rotation of the blowing fan, a second surface spaced from the first surface, and a third surface that connects one side of the second surface to one side of the first surface, wherein the at least one first cut portion and the at least one second cut portion are provided in the first surface, wherein a coupling portion that couples the fan motor to the motor mount is further provided in the first surface, and wherein the coupling portion is provided between the at least one first cut portion and the at least one second cut portion.

2. The air conditioner of claim 1, wherein, when viewed along a rotational axis of the blowing fan, an areal surface of rotation of the blowing fan overlaps with at least a portion of the at least one first cut portion and the at least one second cut portion.

3. The air conditioner of claim 1, wherein the at least one second cut portion is longer than the at least one first cut portion.

4. The air conditioner of claim 1, wherein, the motor mount includes a first motor mount and a second motor mount that support the fan motor on two sides thereof, respectively.

5. The air conditioner of claim 4, wherein the first motor mount and the second motor mount are provided parallel to each other.

6. The air conditioner of claim 4, wherein the at least one first cut portion comprises a first cut portion formed in the first motor mount and the at least one second cut portion comprises a second cut portion formed in the second motor mount which are provided diagonally with respect to an axis of the fan motor, and wherein the at least one second cut portion comprises a second cut portion formed in the first motor mount and the at least one first cut portion comprises a first cut portion formed in the second motor mount which are provided diagonally with respect to the axis of the fan motor.

7. The air conditioner of claim 1, wherein the motor mount farther includes at least one air passage that extends along a longitudinal axis of the motor mount, and wherein the at least one air passage is formed between the first surface and the second surface.

8. The air conditioner of claim 7, wherein the at least one first cut portion and the at least one second cut portion extend from the at least one air passage.

9. The air conditioner of claim 8, wherein the motor mount includes a first motor mount and a second motor mount that support the fan motor on two sides thereof, respectively, and wherein the at least one air passage comprises an air passage formed at the first motor mount and an air passage formed at the second motor mount that extend in a same direction.

10. The air conditioner of claim 1, wherein the at least one first cut portion and the at least one second cut portion are formed to open at one side of the first surface.

11. The air conditioner of claim 1, further comprising a chassis frame that supports both ends of the motor mount, wherein curved portions are formed at both ends of the motor mount so that the motor mount is coupled to and supported by the chassis frame.

12. The air conditioner of claim 1, wherein at least one strength reinforcing portion in the form of a protrusion or indentation is provided in at least one surface of the motor mount.

13. The air conditioner of claim 12, wherein a length of the at least one strength reinforcing portion is equal to or greater than a length of the at least one first cut portion the at least one second cur portion.

14. The air conditioner of claim 12, wherein the at least one strength reinforcing portion is provided in the third surface, in the second surface, or in both the third surface and the second surface of the motor mount.

15. The air conditioner of claim 12, wherein the at least one strength reinforcing portion extends from the at least one first cut portion to the at least one second cut portion.

16. New An outdoor device for an air conditioner, comprising:

a blowing fan comprising a plurality of blades;

a fan motor to rotate the blowing fan; and a motor mount to support the fan motor, wherein at least one first cut portion and at least one second cut portion are formed in the motor mount, wherein air is discharged through the at least one first cut portion and the at least one second cut portion, wherein the motor mount includes a first surface that faces a plane of rotation of the blowing fan, a second surface spaced from the first surface, and a third surface that connects one side of the second surface to one side of the first surface, wherein the at least one first cut portion and the at least one second cut portion are provided in the first surface., wherein a coupling portion that couples the fan motor to the motor mount is further provided in the first surface, and wherein the coupling portion is provided between the at least one first cut portion and the at least one second cut portion.

17. The outdoor device of claim 16, wherein, when viewed along a rotational axis of the blowing fan, an areal surface of rotation of the blowing fan overlaps with at least a portion of the at least one first cut portion and the at least one second cut portion.

18. The outdoor device of claim 16, wherein the at least one second cut portion is longer than the at least one first cut portion.

19. The outdoor device of claim 16, wherein the motor mount includes a first motor mount. and a second motor mount that support the fan motor on two sides thereof, respectively, and wherein the first motor mount and the second motor mount are provided parallel to each other.

20. The outdoor device of claim 16, wherein the motor mount further includes at least one air passage that extends along a longitudinal axis of the motor mount, and wherein the at least one air passage is formed between the first surface and the second surface, and wherein the at least one first cut portion and the at least one second cut portion extend from the at least one air passage.

* * * * *